United States Patent [19]

Rausér et al.

[11] Patent Number: 4,460,425

[45] Date of Patent: Jul. 17, 1984

[54] METHOD FOR THE MANUFACTURE OF A PACKING MATERIAL WITH GOOD GAS-TIGHTNESS PROPERTIES

[75] Inventors: Jan A. I. Rausér, Lomma; Gunnar Knudsen, Södra Sandby, both of Sweden

[73] Assignee: Tetra Pak International A.B., Lund, Sweden

[21] Appl. No.: 463,237

[22] Filed: Feb. 2, 1983

[30] Foreign Application Priority Data

Feb. 10, 1982 [SE] Sweden ..... 8200761

[51] Int. Cl.[3] ..... B29D 7/02

[52] U.S. Cl. ..... 156/244.23; 156/244.11

[58] Field of Search ..... 156/244.11, 244.23, 156/244.24; 428/516, 517, 519, 521

[56] References Cited

U.S. PATENT DOCUMENTS

| | | | |
|---|---|---|---|
| 3,230,135 | 1/1966 | Hurst | 156/244.23 |
| 3,448,000 | 6/1969 | Paquin et al. | 156/244.23 |
| 3,570,748 | 3/1971 | Coyle et al. | 156/244.23 |
| 3,616,191 | 10/1971 | Fuerholzer et al. | 156/244.23 |

*Primary Examiner*—Caleb Weston

*Attorney, Agent, or Firm*—Burns, Doane, Swecker & Mathis

[57] ABSTRACT

The invention relates to a method for the manufacture of packing material with good gas-tightness properties by coating a web or a sheet of paper with an aqueous solution containing polyvinyl alcohol and a thickener, e.g. carboxymethylcellulose, subsequently the water is boiled away and the coating layer formed is covered with a thin plastic film.

7 Claims, 1 Drawing Figure

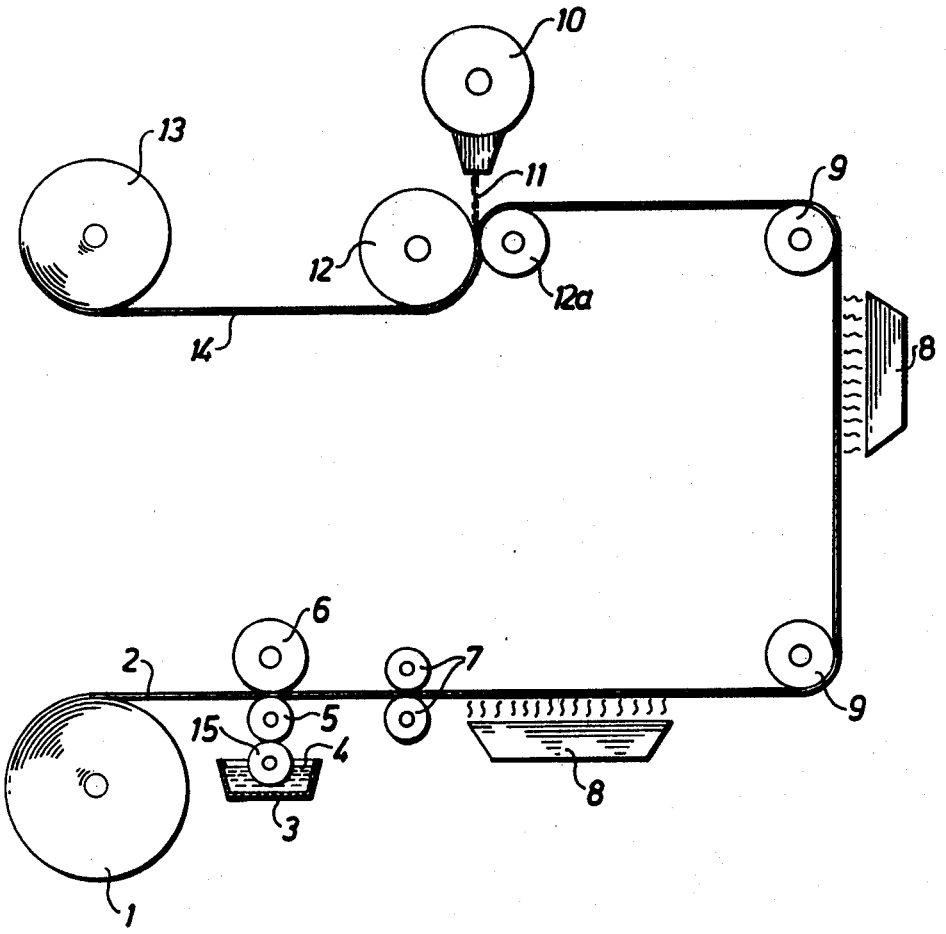
10
13
11
9
12
12a
14
8
6
2
7
5
15
4
9
8
3
1

METHOD FOR THE MANUFACTURE OF A PACKING MATERIAL WITH GOOD GAS-TIGHTNESS PROPERTIES

BACKGROUND AND SUMMARY OF THE INVENTION

The present invention relates to a method for the manufacture of a packing material with good gas-tightness properties. More specifically, the present invention relates to a method for the manufacture of a gas-tight packing material by applying an aqueous solution containing polyvinyl alcohol and a thickener to a sheet, evaporating water in the solution by heating the web and then coating the web by extruding a layer of polyolefin thereon.

It has been known for a long time that certain types of packed products are impaired or ruined if the packing material is not sufficiently gas-tight (i.e., impermeable to gas). In certain foodstuffs, e.g. milk, the taste is affected detrimentally by the action of oxygen gas which penetrates into the packages. It has also been known for a long time that this problem can be solved by using gas-tight layers in the packing material, e.g. metal foil or gas-tight plastics such as polyvinylidene chloride, marked under the trademark SARAN.

A further technical problem, connected with the gas permeability of the packing material, is that packing material which contains a paper layer and an inside layer of plastic coating, e.g. polyethylene, often is susceptible to punctures or ruptures in the polyethylene layer when the packing material is heated, e.g. in connection with sealing or in cases where it is subjected to a sterilizing heat effect. The cause for these ruptures in the plastic layer is that the fibrous paper layer is not completely dry. That is, the paper layer contains a certain degree of moisture which expands in the packing material in the form of bubbles, thereby causing ruptures in the inner polyethyene layer of the packing material softened through heating. These ruptures in the polyethylene layer in general are of no great importance with regard to the gas-tightness. However, if the packing material is used for aseptic packages wherein sterilized contents are enclosed, bacteria may penetrate through the ruptures and infect the sterilized contents. To overcome this disadvantage it is possible to use a gas-tight layer which prevents the vapour bubbles from coming into contact with the softened inner polyethylene layer. In this regard, it is known that a metal foil layer, for example an aluminium foil layer, solves the problem.

As mentioned above, the technical problem referred to here can be solved by using a gas-tight layer of, for example, a metal foil in the packing laminate. Such a metal foil layer, however, is expensive, and efforts have been made to find a cheaper, but nevertheless effective, alternative.

It has been known for a long time that polyvinyl alcohol has good gas-tightness characteristics as long as the material is dry. However, the gas-tightness characteristics deteriorate drastically when the material becomes moist, although this disadvantage can be counteracted to a certain degree by using polyvinyl alcohol of a high degree of hydrolyzation (over 98%). In general the polyvinyl alcohol is applied as an aqueous solution which functions well if the polyvinyl alcohol solution is applied to a nonabsorbing material, such as for example a plastic layer. On the other hand, if the polyvinyl alcohol solution is coated onto an absorbing layer, for example paper, the emulsion is sucked into the paper, without a continuous tight skin of polyvinyl alcohol being formed.

In the present invention a method is described for solving the technical problem of applying a polyvinyl alcohol layer to an absorbent base surface, in particular paper. According to the present invention, an aqueous solution containing polyvinyl alcohol and a thickener is applied to at least one side of a sheet of paper. The water in the aqueous solution is then evaporated by heating. A remaining emulsion layer is then coated by extruding a thin polyolefin layer thereon.

BRIEF DESCRIPTION OF THE DRAWING

The invention will be described with reference to the enclosed schematic drawing which illustrates the process of manufacture of the packing material.

DETAILED DESCRIPTION OF THE PREFERRED EMBODIMENTS

In the figure, a magazine roll 1 contains a weblike packing material. The material in the magazine roll 1 includes a web 2 which may consist of paper material only or of paper material provided previously with a coat of plastic material on one side of the web 2. Preferably, as illustrated in the Figure, a top side of the web 2 has been previously coated with a plastic material. The web 2 is introduced between a pair of transfer rollers 5 and 6, of which the lower transfer roller 5 is a counterpressure roller, which runs against the underside of the web 2 as well as against the periphery of a roller 15. The roller 15 dips down into a container 3 containing a solution 4, the composition of which will be discussed in more detail in the following. The solution 4 is transferred via the roller 15 to the transfer roller 5 which in the course of rolling against the inside of the web 2 will apply and completely cover the web 2 with a uniformly thick layer of the solution 4.

Any excess of the solution 4 can be removed with the doctor arrangement 7 which also contributes to a more uniform distribution of the solution 4 over the surface of the web 2. The doctor arrangement 7 may also include an air brush which blows off the excess liquid. Since the solution 4 as applied contains water which has to be removed, the web 2 is conducted past a heating strip 8 which heats the applied solvent layer applied is heated so that the water is made to evaporate to a substantial degree. Accordingly, a layer containing only a limited moisture content remains on the web 2. The web thus treated is then passed over guide rollers or guide cylinders 9 whilst continued drying through heating and air-blowing is carried out. A protective polyethylene layer 11 can be applied with an extruder 10 to the applied layer when it is led past the extruder 10. The applied polyethylene layer 11 is fixed by being pressed against the web by cooling rollers 12 and the rubber-covered cylinder **12*a*. The finished web 14 is wound up on a magazine roll 13**.

As mentioned previously, the liquid or solution 4 in the vessel 3 must not be a pure aqueous solution containing polyvinyl alcohol, since such an aqueous solution is absorbed into the fibrous paper layer 2 and does not form a continuous tight skin when the water in the solution is removed by evaporation. Similarly it is not possible without difficulties to coat a polyvinyl alcohol layer with polyethylene, since the adhesion between the polyethylene layer and the polyvinyl alcohol layer will be unsatisfactory. To solve this problem, the liquid 4 in the vessel 3 must have a very special composition. To prevent the absorption of the polyvinyl alcohol solution into the paper web 2, a thickener is mixed into the solution which provides the liquid with a more viscous consistency. This means that the viscous layer applied by the transfer roller 5 does not penetrate into the paper web by absorption, since the water in the solution is bonded to the viscous liquid 4. As a result the polyvinyl alcohol forms a continuous layer lying on the web after the water in the viscous liquid 4 has been boiled away by the heating arrangements 8.

To facilitate the application of a polyethylene layer 11 by means of extrusion onto the polyvinyl alcohol layer which has been applied, the liquid 4 also contains a priming medium which facilitates adhesion between polyethylene and polyvinyl alcohol. In the preferred embodiment the priming medium consists of polyethylene imine. The liquid 4 in the vessel 3 thus consists of an aqueous solution which contains approximately 5 percent by weight of polyvinyl alcohol, approximately 0.5 percent by weight of an alginate or carboxymethylcellulose, approximately 0.5 percent by weight of polyethylene imine and the remaining parts water. The polyvinyl alcohol may be supplied as a powder which is dissolved in the water, and the polyvinyl alcohol ought to have a degree of hydrolyzation which exceeds 80%, preferably 90% or higher. With the thickener, the liquid 4 becomes a viscous structure which prevents absorption in the paper layer. However the liquid can be readily spread out in a uniform layer over the web 2 with the device 7, which also removes any excess of the coating medium. If alginate is used, a gelling of the solution applied is also obtained because the alginate reacts with aluminium present in the paper. This reaction prevents the solution from penetrating into the paper and therefore facilitates film formation.

After the application of the liquid 4, the water in the solution is removed in the manner as described above through heating and possibly air-blowing to such a degree that the water content prior to the plastic coating is less than 10 percent by weight of the total coating. This means that the polyvinyl alcohol content in the finished layer will rise to approximately 80%.

The polyvinyl alcohol layer applied in the abovementioned manner provides the laminate with substantially improved gas-tightness and prevents steam bubbles from penetrating the inner plastic layer 11 when the packing material is heated in connection with its sterilization. An alternative method of solving the problem of absorption includes pretreating the paper web with a calcium compound (e.g. $CaCl_2$). If the paper web has been pretreated with a surface layer of such a calcium compound a very rapid gel formation of the added alginate can be obtained. The advantage of this process is that the alginate-polyvinyl alcohol solution gels instantly when it is applied to the paper surface because of the ample supply of calcium which can react with the alginate. As a result absorption is prevented and film formation is promoted.

The method in accordance with the invention solves a problem that has been known for a long time, namely the replacing the aluminium foil layer in the packing laminate with something which is substantially cheaper. Practical tests have shown that the packing laminate in accordance with the invention in the majority of cases fulfils the demands made on gas-tightness. The process has also proved to be effective in hindering the generation of blisters and holes in the inner polymer layer when the packing material is heated.

The principles, preferred embodiments and modes of operation of the present invention have been described in the foregoing specification. The invention which is intended to be protected herein should not, however, be construed as limited to the particular forms disclosed, as these are to be regarded as illustrative rather than restrictive. Variations and changes may be made by others without departing from the spirit of the present invention.

We claim:

1. A method for the manufacture of a packing material with good gas-tightness properties, comprising the steps of pretreating a sheet or a web of paper or cardboard by coating at least one side of said sheet or web with a calcium compound, applying a layer of an aqueous solution containing polyvinyl alcohol and a thickener to said at least one side of said sheet or web of paper or cardboard, evaporating water in the solution by heating the web to form an emulsion layer thereon and, coating the remaining emulsion layer by extruding a thin polyolefin layer thereon.

2. The method in accordance with claim 1, wherein the aqueous solution contains between 2 and 10 percent by weight of polyvinyl alcohol, between 0.1–2% of a thickener, and 0.1–1% polyethylene imine, and the step of evaporating includes boiling away the solution as applied by heating the web to such an extent that the water content is diminished to approximately 10 percent by weight.

3. The method in accordance with claim 1, wherein the polyvinyl alcohol has a degree of hydrolyzation which exceeds 80%.

4. The method in accordance with claim 1, wherein the calcium compound is calcium chloride.

5. The method in accordance with claim 1, wherein the thin polyolefin layer is polyethylene.

6. The method in accordance with claim 2, wherein the aqueous solution contains 5.0 percent by weight of polyvinyl alcohol, 0.5 percent by weight of a thickener, and 0.3 percent by weight of polyethylene imine.

7. The method in accordance with claim 2, wherein the thickener is alignate.

* * * * *